US006634434B2

(12) United States Patent
Ohzeki et al.

(10) Patent No.: US 6,634,434 B2
(45) Date of Patent: Oct. 21, 2003

(54) BEACH CLEANER

(75) Inventors: Takashi Ohzeki, Saitama (JP); Yoshihiro Kimura, Saitama (JP); Yasuji Hashimoto, Saitama (JP); Yoshinobu Itani, Saitama (JP); Takashi Shinozaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/971,182

(22) Filed: Oct. 5, 2001

(65) Prior Publication Data

US 2002/0040796 A1 Apr. 11, 2002

(30) Foreign Application Priority Data

Oct. 6, 2000 (JP) ..... 2000-308493

(51) Int. Cl.[7] ..... A01B 43/00
(52) U.S. Cl. ..... 171/63; 171/DIG. 2; 171/111
(58) Field of Search ..... 171/DIG. 2, 65, 171/19, 45, 144, 63, 114, 116; 15/3, 93.1, 93.3, 83, 84; 56/327.1

(56) References Cited

U.S. PATENT DOCUMENTS

| | | | | | |
|---|---|---|---|---|---|
| 1,313,053 | A | * | 8/1919 | Beard | 171/118 |
| 1,578,600 | A | * | 3/1926 | Greatrix | 171/101 |
| 2,296,851 | A | * | 9/1942 | Henry | 171/9 |
| 2,419,154 | A | * | 4/1947 | O'Brien | 171/98 |
| 2,733,904 | A | * | 2/1956 | Gauthier et al. | 171/116 |
| 2,856,013 | A | * | 10/1958 | Evans | 171/9 |
| 2,990,019 | A | * | 6/1961 | Finn | 171/89 |
| 3,316,977 | A | * | 5/1967 | Snook | 171/25 |
| 3,786,870 | A | * | 1/1974 | List | 171/129 |
| 3,807,154 | A | * | 4/1974 | Moore | 414/440 |
| 4,014,390 | A | * | 3/1977 | Teixeira | 171/124 |
| 4,290,820 | A | * | 9/1981 | Swisher et al. | 134/6 |
| 4,482,019 | A | * | 11/1984 | Murphy | 171/63 |
| 5,133,413 | A | * | 7/1992 | Baxter | 171/63 |

FOREIGN PATENT DOCUMENTS

| | | |
|---|---|---|
| DE | 2321271 | * 10/1974 |
| JP | 2-161003 | * 6/1990 |
| JP | 2-261110 | * 10/1990 |
| JP | A3 138203 | 6/1991 |
| JP | 11-229338 | * 8/1999 |

* cited by examiner

*Primary Examiner*—Victor Batson
(74) *Attorney, Agent, or Firm*—Birch, Stewart, Kolasch & Birch, LLP

(57) ABSTRACT

A beach cleaner for traveling on sandy soil while being towed by a traction vehicle for recovering waste such as empty cans scattered on the sandy soil. The beach cleaner is provided with a travel body. The travel body includes a plurality of longitudinal members arranged in a hurdle shape spacedly and extending in a travel direction and also having in a front portion thereof a portion to be pulled by the traction vehicle. A flat plate-like scraper for scraping up waste together with sand during travel of the beach cleaner is provided in the front portion of the travel body. A net for separating waste from a mixture of sand and waste scraped up by the scraper and for storing the thus-separated waste thereon is stretched on an upper surface of the travel body.

18 Claims, 7 Drawing Sheets

BEACH CLEANER

CROSS-REFERENCE TO RELATED APPLICATIONS

The present application claims priority under 35 USC 119 to Japanese Patent Application No. 2000-308493 filed on Oct. 6, 2000 the entire contents thereof is hereby incorporated by reference.

BACKGROUND OF THE INVENTION

1. Field of the Invention

The present invention relates to a beach cleaner for recovering waste such as empty cans scattered on a sandy soil.

2. Description of Background Art

Heretofore, a beach cleaner has been known for recovering waste such as rope, driftwood, empty cans, cigarette butts, and paper scraps scattered on a sandy beach such as a bathing beach, for example, a beach cleaner as disclosed in Japanese Patent Laid-open No. Hei 3-138203.

The beach cleaner disclosed in the above publication is what is called a self-traveling type cleaner having a travel body integrally formed with a cleaner body. According to this construction, waste is scooped up together with sand by a scoop-up section provided in a front portion of the cleaner body, the waste and sand thus scooped up are then classified into waste and sand while being conveyed by a conveyance section such as a belt conveyor, and only the waste is recovered by a waste recovery section provided in a rear portion of the cleaner body.

The above conventional beach cleaner involves the following problems. The conventional beach cleaner is a self-traveling type having a travel portion integrally with the cleaner body. In addition, a scoop-up section for scooping up waste, etc., a conveyance section for the conveyance of the scooped-up waste, etc., and a waste recovery section are provided in the cleaner body, thus giving rise to the problem that the entire structure of the beach cleaner becomes complicated and becomes large in size.

Accordingly, there also arises the problem that the beach cleaner becomes heavier and more expensive.

Further, since the entire structure of the beach cleaner becomes complicated and larger in size as mentioned above, it is difficult to carry out maintenance work.

SUMMARY AND OBJECTS OF THE INVENTION

The present invention has been accomplished in view of the above-mentioned circumstances and it is an object of the invention to provide a beach cleaner reduced in size, weight and cost that is capable of effecting the recovery of waste in a simple manner, and requiring a minor amount of maintenance work.

It is another object of the present invention to provide a beach cleaner that is capable of efficiently recovering even relatively small waste mixed in sand such as cigarette butts.

For solving the above-mentioned problems, according to the present invention there is provided a beach cleaner adapted to travel on a sandy soil while being towed by a traction vehicle to recover waste such as empty cans scattered on the sandy soil, the beach cleaner comprising a travel body for carrying waste recovered during travel. The travel body includes a plurality of longitudinal members. In a front portion thereof, a portion to be towed by the traction vehicle, the longitudinal members are arranged in a hurdle shape spacedly in the transverse direction. A flat plate-like scraper for scraping up waste together with sand during travel is disposed in the front portion of the travel body so as to cross the travel body.

According to this configuration, since a flat plate-like scraper is provided in the front portion of the travel body so as to cross the travel body, the scraper scrapes up waste together with sand when the traction vehicle tows the travel body at a predetermined speed on a sandy soil. Thus, without using any special power, waste can be scraped up together with sand and can be recovered selectively behind the scraper with the use of a suitable means.

According to the present invention there is provided a beach cleaner wherein a net for separating waste from the waste-sand mixture scraped up by the scraper and for storing the waste is stretched on an upper surface of the travel body.

According to this configuration, sand and waste scraped up by the scraper are transferred onto the net stretched on the upper surface of the travel body. Since the travel body oscillates minutely during travel, the net also oscillates minutely, so that only the sand drops through the mesh of the net, allowing only the waste to remain on the net, and thus the waste is separated from the sand.

According to the present invention there is provided a beach cleaner wherein the front portion of the travel body is provided with a slant portion which is higher in a forward direction. According to this configuration, since the front portion of the travel body is provided with a slant portion, the slant portion diminishes a running resistance during travel.

According to the present invention there is provided a beach cleaner wherein a rear portion of the travel body is provided with a slant portion which is higher in a rearward direction.

According to this configuration, even when the travel body oscillates minutely during travel, waste which has been collected by the net can be prevented from dropping from the rear portion of the travel body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A beach cleaner according to an embodiment of the present invention will be described hereinunder with reference to the drawings.

The beach cleaner 1 is adapted to travel on a sandy soil while being towed by a traction vehicle such as a three- or four-wheeled buggy for off-road travel to recover waste such as empty cans scattered on the sandy soil.

Figure 2:
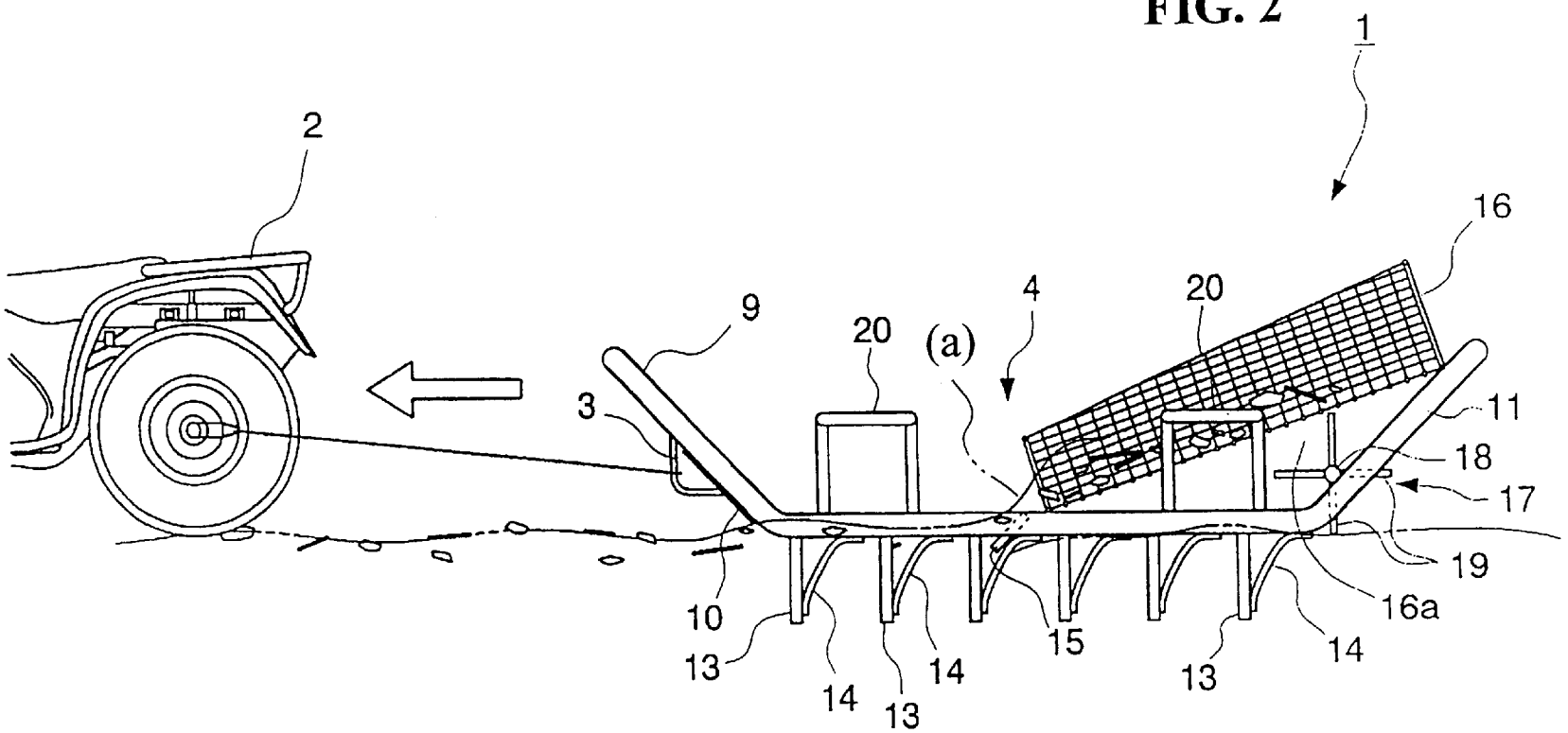
FIG. 2 is a side view of the beach cleaner.
Figure 3:
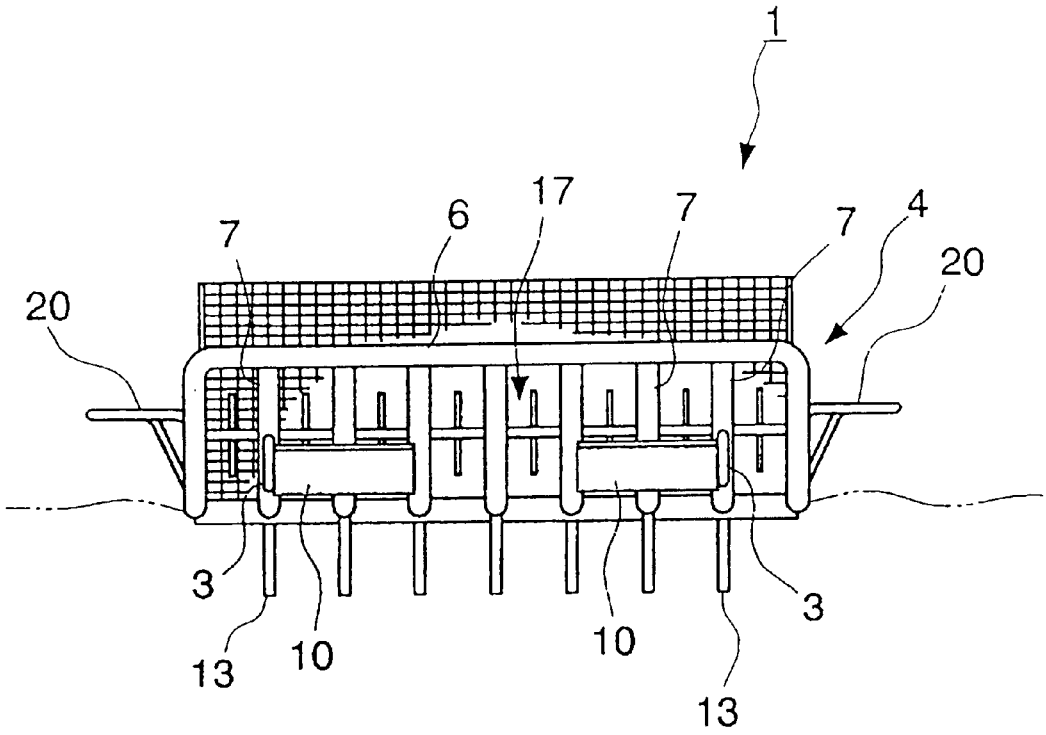
FIG. 3 is a front view of the beach cleaner.

The beach cleaner 1 is constituted mainly by a travel body 4 which is generally square in shape in plan and wherein a to-be-towed portion 3 is pulled by a traction vehicle 2, thereby causing the travel body 4 to travel, see FIGS. 2 and 3.

The travel body 4 comprises an outer frame 6 assembled in a square shape in plan and a plurality of longitudinal members 7 extending in a traveling direction of the travel body and arranged in a hurdle shape inside the outer frame 6, the longitudinal members 7 are spaced from one another in the transverse direction and are fixed at both ends thereof to the outer frame 6 by fixing means such as welding. The outer frame 6 and the longitudinal members 7 may be constituted by stainless steel pipes or by surface-rustproofed pipes or solid rods or square lumber.

The width Wa of the travel body 4 is set to a value which is larger than the width Wb of the traction vehicle 2 including tires and which, even at a maximum width, does not exceed twice the width Wb. The length L of the travel body 4 is set to a value almost equal to the width Wa of the travel body. The reason why the width Wa of the travel body 4 is set larger than the width Wb of the traction vehicle 2 is based on a relation thereof to a waste station 22 which will be described below. The reason why the width Wa of the travel body 4 is set to a value not exceeding twice the width Wb of the traction vehicle is because if it is set to a very large value, an increase in running resistance results and there is a fear that traction at a suitable speed may become infeasible. This is also true of the reason why the length L of the travel body 4 is not set so long.

The spacing Wc between adjacent longitudinal members 7 in the travel body 4 is set larger than the diameter of at least a can for beverage. More particularly, the spacing Wc of the longitudinal members 7 is set at about 5 to 10 cm.

In a front portion of the travel body 4 is formed a slant portion 9 which is higher in a forward direction. Flat plates 10 for diminishing a running resistance are fixed to right and left positions of the slant portion 9 so as to straddle longitudinal members 7 by suitable fixing means such as welding.

Also in a rear portion of the travel body 4 is formed a slant portion 11 which is higher in a rearward direction.

Figure 1:
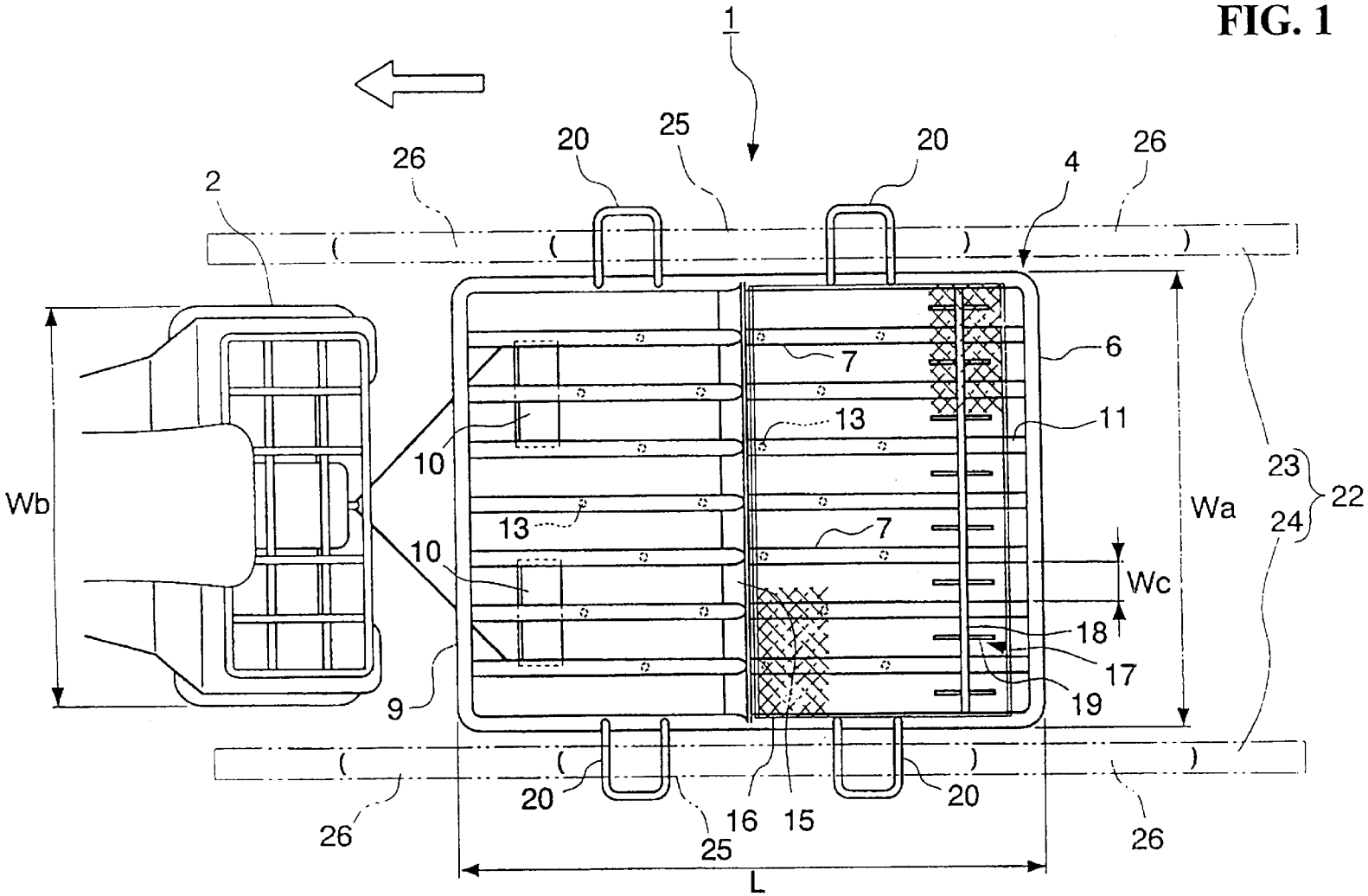
FIG. 1 is a plan view showing a beach cleaner according to an embodiment of the present invention.

A plurality of pins 13 are secured to the outer frame 6 and the longitudinal members 7 so as to project downwardly. The pins 13 are arranged in a zigzag fashion so as to be positioned at vertices of a triangle when seen from above, as shown in FIG. 1. A rear side in the traveling direction of each pin 13 is reinforced with a reinforcing member 14 in a triangularly tapered shape in side view so as to be narrower in a downward direction.

A scraper 15 for scraping up sand during travel is mounted in the front portion of the travel body 4 at a position slightly behind the front slant portion 9 so as to cross the travel body 4. The scraper 15, which is in the shape of a flat plate, is mounted between the outer frame 6 and the longitudinal members 7 and also between adjacent longitudinal members 7 by fixing means such as welding in such a manner that the mounting angle with respect to the horizontal plane is in a range of 30° to 60°.

Not only the scraper 15 but also the pins 13 fulfill the sand scraping function.

A net 16 for storing collected waste is stretched on a rear portion of an upper surface of the travel body 4. The net 16 is mounted removably so that a front end thereof is positioned behind the scraper 15 and the net extends therefrom up to a position near a rear end of the rear slant portion 11. The reason why the net is made removably is because it becomes unnecessary when a first stage of the waste recovering method which will be described later is carried out. A mixture of waste and sand scraped up by the scraper 15 during travel is put on an upper surface of the net 16 and only sand drops through the mesh of the net, allowing the waste thus separated from the sand to remain on the upper surface of the net. Therefore, the mesh size is set at a value which permits sand to drop but does not permit passage therethrough of waste such as cigarette butts, etc.

Plural nets 16 of different mesh sizes may be provided in advance and one of them may be selected and used according to the type of sand. A space 16*a* is formed below the net 16 so that sand can be swept away smoothly through the mesh.

A rotor 17 is mounted removably in the rear portion of the travel body 4 at a somewhat backwardly downward position with respect to a front end of the rear slant portion 11. The rotor 17 is made up of a horizontal shaft 18 which is supported by the outer frame 6 rotatably through bearings and blades 19 which are mounted on the horizontal shaft 18 so as to extend radially outwardly from the horizontal shaft and at predetermined intervals in the axial direction of the horizontal shaft. The length of each blade 19 is set to a degree which permits a slight contact of the blade with the surface of a sandy soil when the travel body 4 is brought into contact with the sandy soil. During travel, the rotor 17 is rotated by abutment of tips of the blades 19 against the surface of sand.

Arms 20 are formed on both right and left side portions of the travel body 4 and project sideways. A total of four arms 20 are provided, two on each side, and the height of each arm 20 is set to a predetermined value.

When the travel body 4 reaches a waste station 22 (a waste recovery place) assembled at a predetermined place on the sandy soil, as shown in FIG. 1, the arms 20 engage right and left flat intermediate portions 25 which constitute the waste station 22, thereby lifting the travel body 4 upwardly.

The waste station 22 includes by a pair of right and left pipes 23, 24 which are formed in a predetermined shape (see FIG. 1). The pipes 23 and 24 each have a flat intermediate portion 25 and front and rear slope portions 26 located on front and rears sides, respectively, of the flat intermediate portion 25. The pipes 23 and 24 are supported at a plurality of positions by legs 27, whereby the flat intermediate portions 25 of both pipes are held at a predetermined height. In the waste station 22, the right and left pipes 23 and 24 may each be constituted integrally, or there may be adopted an assembling method wherein the pipes are each divided into plural portions and the divided portions are assembled at an assembling site for the waste station.

The operation of the beach cleaner constructed as above will be described below.

The beach cleaner 1 is transported to a site where waste is to be recovered, such as a bathing beach. Then wire or the like is hooked to the to-be-towed portion 3 provided in the front portion of the beach cleaner 1 and the beach cleaner 1 is allowed to travel at a constant speed on a sandy soil while being towed by the traction vehicle 2.

Figure 7:
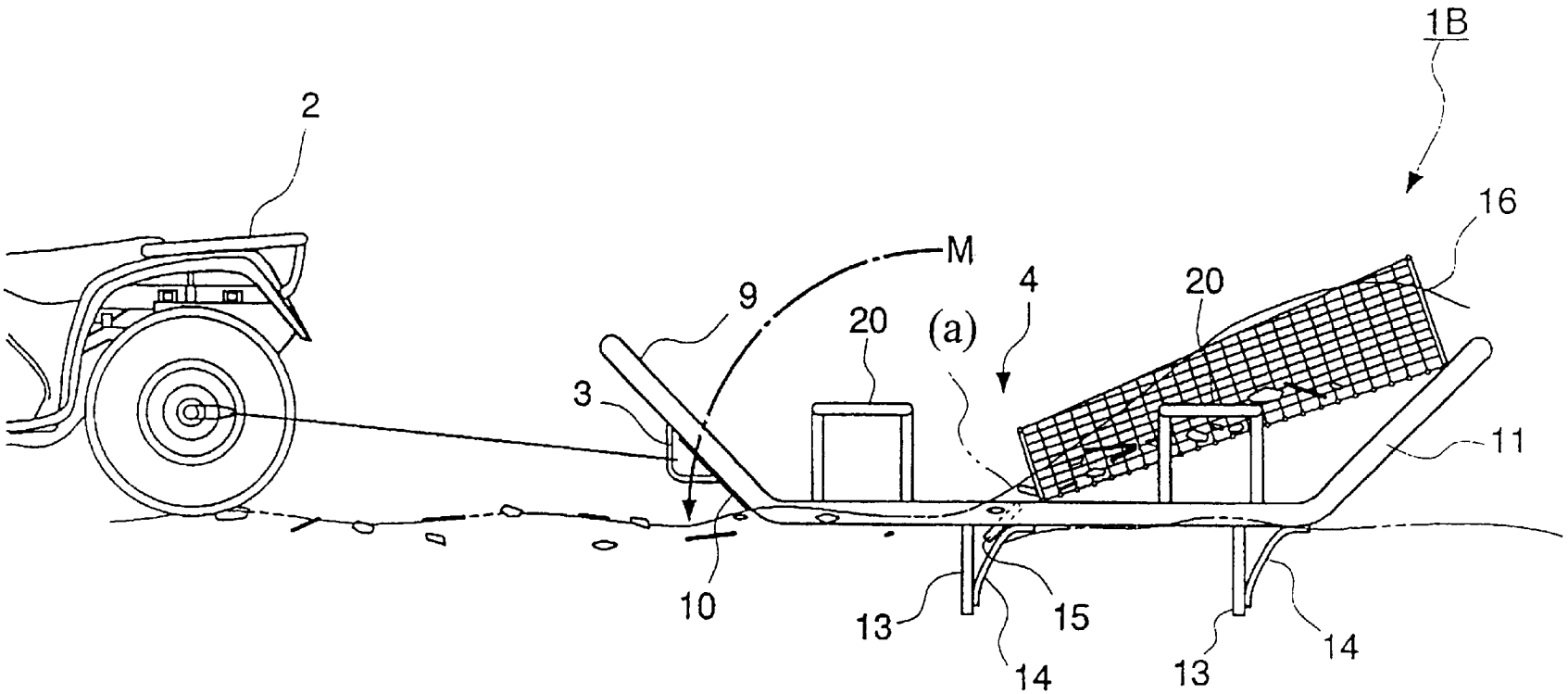
FIG. 7 is a side view explaining a waste recovering method which uses the beach cleaner shown in FIG. 6.

Waste recovering methods using the beach cleaner 1 are broadly classified into two. According to one method, a first stage of waste recovering method, as shown in FIG. 2, the beach cleaner 1 is allowed to travel at a relatively low speed, allowing the pins 13 to act like a rake and thereby allowing waste to be caught on the pins. According to the other method, a second stage of waste recovering method, as shown in FIG. 7, while the beach cleaner 1 is allowed to travel at a relatively high speed, waste is scraped up together with sand by the scraper 15 and relatively small waste such as cigarette butts are recovered by the net 16 provided on rear portion of the travel body 4. Usually, the first stage of waste recovering method is applied first.

For both first and second stages of waste recovering methods there may be used the common beach cleaner 1 shown in FIGS. 1 to 3 as a common beach cleaner, but there may be used beach cleaners 1A and 1B dedicated respectively to the first and second stages of waste recovering methods.

The first stage of waste recovering method will now be described more concretely. By allowing the beach cleaner 1 to travel at a low speed (say, 10 to 15 km/h) in a removed state of the net 16, the pins 13 penetrate relatively deep into the sandy soil, whereby the sandy soil is dug up during the movement of the beach cleaner.

Figure 5:
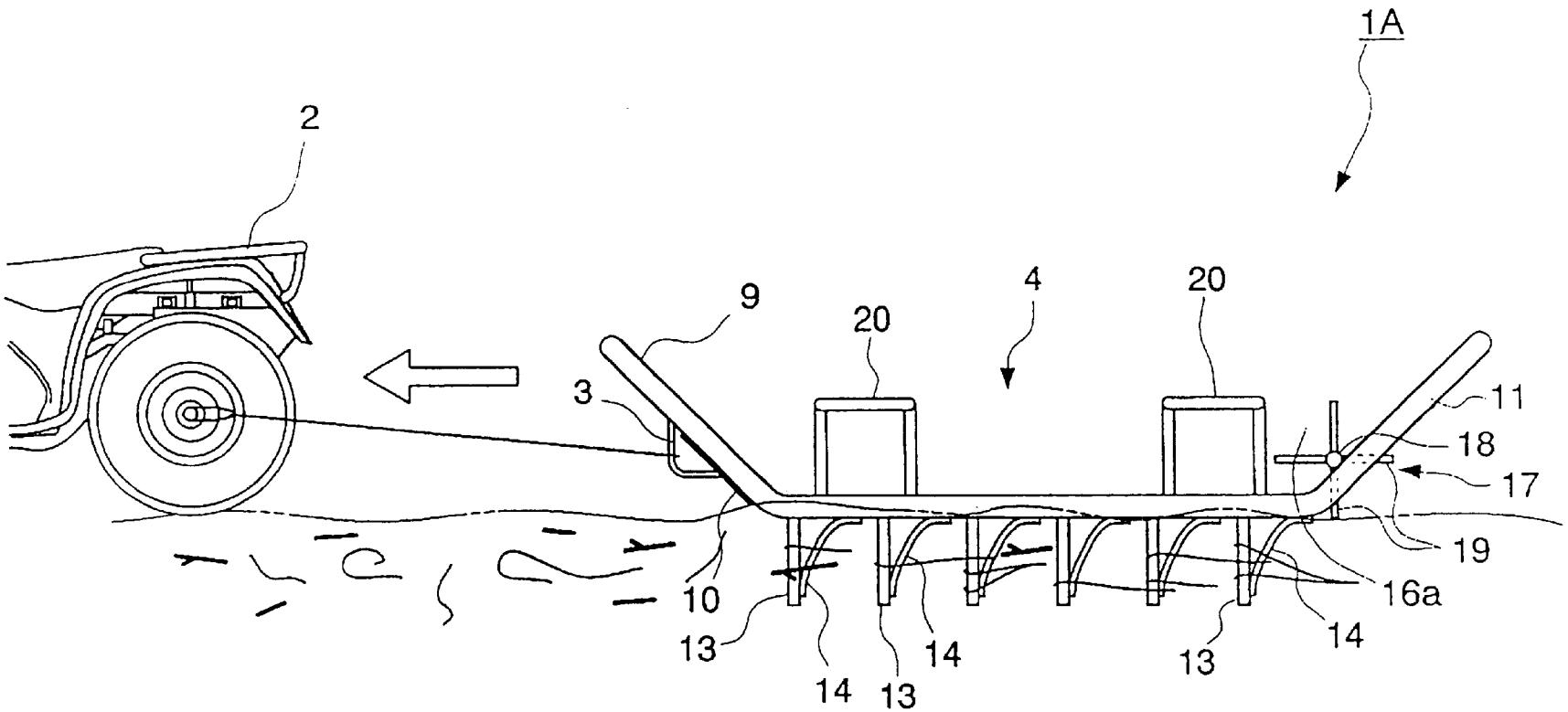
FIG. 5 is a side view explaining a waste recovering method which uses a beach cleaner according to another embodiment of the present invention.

A supplemental explanation will now be given about the dedicated beach cleaner 1A for practicing the first stage of the waste recovering method shown in FIG. 5. The beach cleaner 1A is different from the common beach cleaner 1 in that firstly the scraper 15 is not used and secondly the net 16 is not used, either.

When the beach cleaner 1 (1A) is allowed to travel at a low speed as noted above, elongated waste such as ropes and nets present on the surface of a sandy soil or buried in the sandy soil are caught on the pins 13 and are carried by the travel body 4 while being dragged by the pins 13. When relatively large waste such as driftwood or stones are present on a sandy soil, this waste cannot pass between adjacent pins 13, but is pushed by a plurality of pins 13 while straddling adjacent pins or while being entangled between adjacent pins. In this state the waste is carried by the travel body 4.

On the other hand, relatively small waste such as empty cans are not caught on the pins 13, but pass between adjacent pins 13 and remain on the sandy soil as they are. Further, among such waste as PET bottles and empty cans there are included those which pass between adjacent longitudinal members 7 and reach an upper side of the longitudinal members.

When the waste thus having reached the upper side of the longitudinal members 7, i.e., an upper side of the travel body 4, accumulate therein in a certain volume, the rotor 17 which rotates with the tips of the blades 19 in contact with the surface of the sandy soil usually no longer rotates because waste is caught on the blades 19.

As a result, a driver of the traction vehicle 2 or a worker working in the waste station becomes aware that a certain volume of waste has accumulated on the travel body 4. Thus, the rotor 17 serves as a sensor for detecting whether a certain volume of waste has accumulated on the travel body 4.

When the beach cleaner 1 is allowed to travel at a low speed as mentioned above, the pins 13 dig out the sandy soil and there accrues an advantage that the sandy soil is softened.

When the amount of waste caught on the pins 13 has exceeded a predetermined amount or the rotor 17 becomes unrotatable after a certain distance of travel of the beach cleaner 1, the beach cleaner 1 is brought to the waste station 22.

Figure 4:
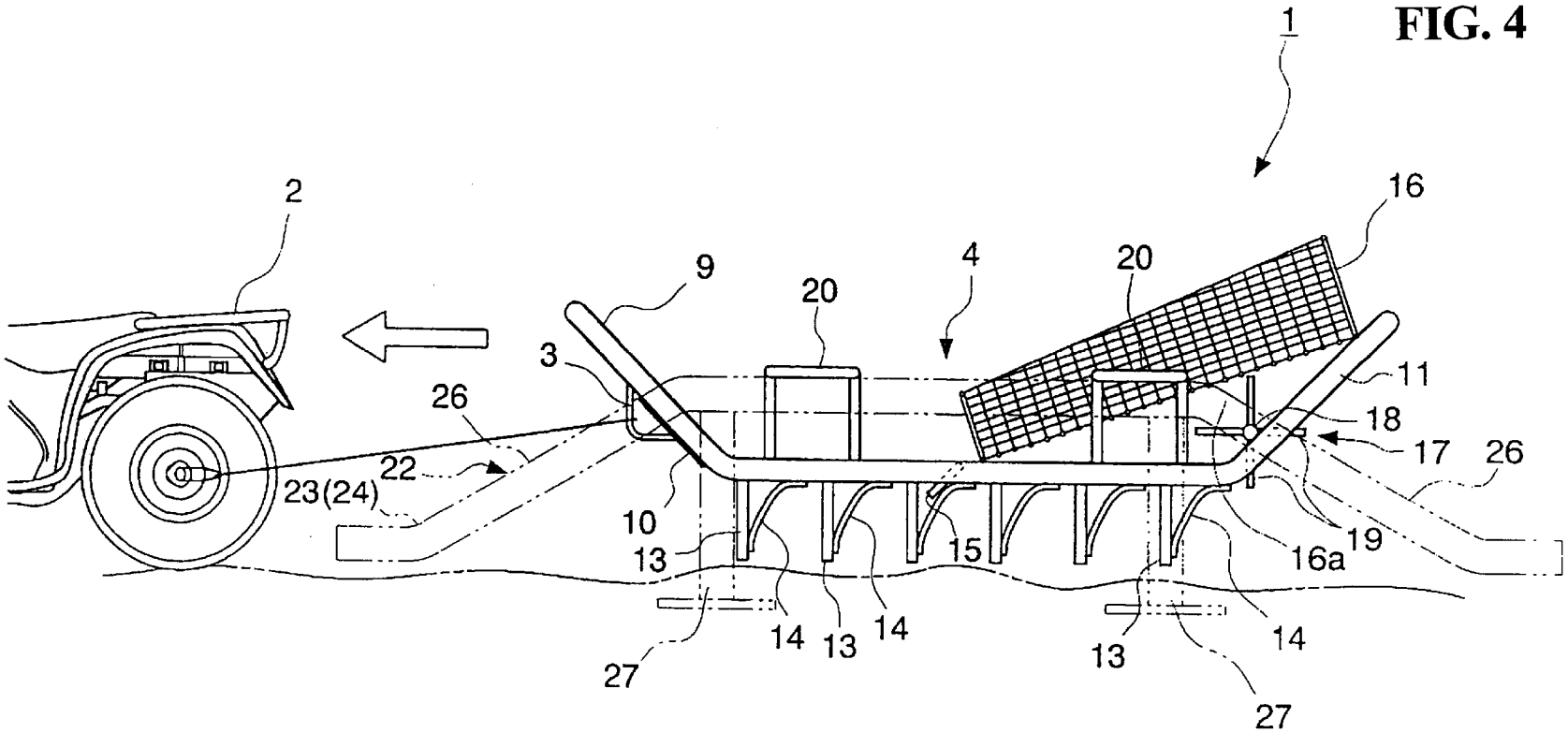
FIG. 4 is a side view explaining a waste recovering method which uses the beach cleaner.

More specifically, as shown in FIGS. 1 and 4, the traction vehicle 2 passes between a pair of pipes 23 and 24 and stops at predetermined front position. At this time, the right and left arms 20 which overhang sideways of the beach cleaner 1 get onto the slope portions 26 of the pipes 23 and 24, then rise gradually and reach the flat intermediate portions 25. When the arms 20 thus reach the flat intermediate portions 25 of the pipes 23 and 24, the travel body 4 assumes a lifted state by the waste station 22 through the arms 20. At this time, lower ends of the pins 13 are spaced away from the surface of the sandy soil.

As a result, elongated waste so far caught on the pins 13 drop by their own weight. Relatively large waste such as driftwood also remains on the surface of the sandy soil because the pins 13 are lifted away from the sandy soil surface.

Thus, by allowing the beach cleaner 1 to travel at a relatively low speed on the sandy soil, elongated waste such as wires, nets, and strings, as well as relatively large waste such as driftwood, can be recovered in the position of the waste station without relying on manual labor. The waste present on the travel body 4 are removed manually.

Next, a description will be given below about the latter second stage of waste recovering method. According to this method, the beach cleaner 1 (1B) is allowed to travel at a high speed (say, 30 to 35 km/h).

Figure 6:
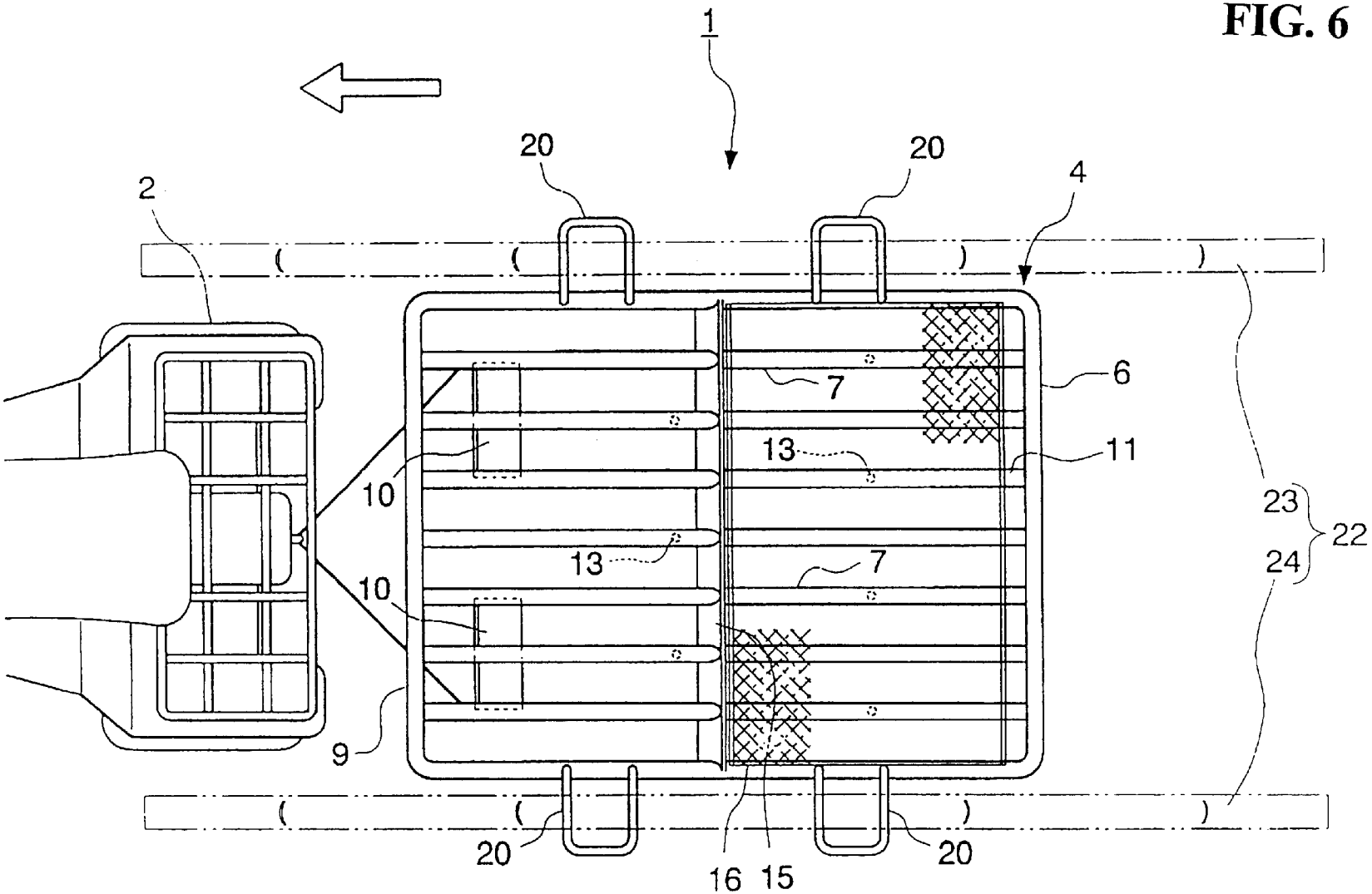
FIG. 6 is a front view of a beach cleaner according to a further embodiment of the present invention.

Here, a supplementary explanation will be given about the beach cleaner 1B dedicated to the second stage of waste recovering method shown in FIGS. 6 and 7. The beach cleaner 1B is different from the common beach cleaner 1 in that firstly the number of pins 13 is small and secondly the rotor 17 is not used. Nearly centrally of the travel body 4 pins 13 are arranged in a line at a side position. With such pins 13 arranged nearly centrally and the scraper 15 positioned behind the pins, sand is scraped vigorously obliquely upwardly and rearwardly. Ahead of the rear slant portion 11, pins 13 are also arranged in a line. The pins are for preventing the travel body 4 from trying to rotate under the action of a moment M when sand is scraped up by the pins 13 arranged nearly centrally of the travel body 4.

When the beach cleaner 1 (1B) is allowed to travel at a high speed as mentioned above, sand which forms a surface layer of the sandy soil is scraped up by the pins 13 and the scraper 15, as a line (a) shown in FIG. 7, coupled with the state that the surface of the sandy soil has been softened by the travel of the beach cleaner 1 (1A) in the previous stage, then the sand thus scraped up is transferred onto the net 16 stretched in the rear portion of the travel body while forming a certain flow as if the sand were a fluid. Relatively small waste such as cigarette butts, PET bottles, PET bottle caps, empty cans, and paper scraps are mixed in the sand which forms the surface layer of the sandy soil and this waste is also transferred onto the net 16 together with the sand.

The net 16 oscillates minutely because the beach cleaner is in motion, so that only the sand out of the waste and sand which has been transferred onto the net 16 drops through the mesh of the net. Further, at a certain particular traveling speed, sand which has been scraped up vigorously reaches and strikes against an upright portion on the rear side of the net 16 and tries to pass through the mesh of the net. After all, only the waste remains on the net 16 and thus is separated from the sand. In this way relatively small waste mixed in the surface layer sand of the sandy soil, such as cigarette butts, PET bottles, and PET bottle caps, can be recovered.

When a certain amount of waste is accumulated on the net 16, the driver returns to the waste station 22, where the driver or a worker removes the waste recovered in the net 16, with use of a broom or the like.

By repeating both first and second stages of waste recovering methods it is possible to recover all of elongated waste and relative large and small waste which are scattered on a sandy beach.

Preferably, the pins 13 used in the first stage of waste recovering method and the pins 13 used in the second stage of waste recovering method are different in length and the latter pins are shorter. This is because in the second stage of waste recovering method the action of scraping up a larger amount of sand by the scraper 15 takes priority over the action of catching waste buried in a sandy soil by the pins 13. In addition, since the travel body 4 is allowed to travel at a high speed the running resistance is diminished.

The pins 13 may be constructed so that their downwardly projection quantity can be adjusted using a length adjusting means such as a screw mechanism or the like. In this case, shorter pins 13 are used in the second stage of the waste recovering method than in the first stage of waste recovering method.

Further, the longitudinal members 7 may be constructed removably so that some of them can be removed in executing the waste recovering work if the running resistance is too large.

The beach cleaner according to the present invention is of the type which is towed by a traction vehicle, having neither power nor waste conveying means, so that the entire construction can be simplified. Consequently, it is possible to attain a reduction in size, weight and cost and also possible to eliminate the need for maintenance work.

Since a flat plate-like scraper is provided in the front portion of the travel body so as to cross the travel body, when the travel body is towed on sandy soil at a predetermined speed by means of a traction vehicle, the scraper scrapes up waste together with sand and the waste is recovered behind the scraper by a suitable means, whereby relatively small waste mixed in sand such as cigarette butts can also be recovered efficiently.

According to the present invention, of the sand and waste scraped up by the scraper, only the waste can be recovered without using any special power.

According to the present invention since a slant portion is provided in the front portion of the travel body, the slant portion diminishes the running resistance during travel of the beach cleaner. Therefore, the travel body can be towed at a certain speed even by a traction vehicle having a relatively small traction force.

According to the present invention, even when the travel body oscillates minutely, waste collected by the net can be prevented from dropping from the rear portion of the travel body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cleaner for recovering waste from a ground surface comprising:

an outer frame, said outer frame including a front portion adapted for attachment to be towed by a traction vehicle, a plurality of longitudinal members extending along said outer frame in a direction of travel, said longitudinal members including projections extending downwardly therefrom;

a scraper for scraping up waste together with sand during travel, said scraper being disposed to extend across a travel body for delivering waste from sandy soil to the travel body;

a rotor being displaced a predetermined distance relative to said scraper for engaging the ground surface during movement of the outer frame; and a net for separating waste from a mixture scraped up by said scraper and for storing the waste, said net being stretched on an upper surface of said travel body.

2. The cleaner according to claim 1, wherein the front portion of said outer frame is provided with a slant portion having an upwardly extending front end.

3. The cleaner according to claim 1, wherein a rear portion of said outer frame is provided with a slant portion having an upwardly extending rear end.

4. The cleaner according to claim 1, wherein said outer frame includes said front portion, a left side member, a right side member and a rear member connected together for supporting said plurality of longitudinal members extending in the traveling direction of the cleaner.

5. The cleaner according to claim 1, wherein a plurality of said downwardly projecting members extends downwardly from said longitudinal members for engaging the ground surface for dislodging waste therefrom.

6. A cleaner for recovering waste scattered on a ground surface, said cleaner comprising:

a travel body for carrying waste recovered during travel, said travel body having a plurality of longitudinal members and having in a front portion thereof a portion to be towed by a traction vehicle, said longitudinal members being arranged in a hurdle shape spacedly extending in a traveling direction of the cleaner;

a scraper for scraping up waste together with sand during travel, said scraper extending in a transverse direction of said travel body for delivering waste upwardly and away from sandy soil for removal of the waste;

a rotor being displaced a predetermined distance relative to said scraper for engaging the ground surface during movement of the travel body; and a plurality of downwardly projecting members extending downwardly from said longitudinal members for engaging the ground surface for dislodging waste therefrom.

7. The cleaner according to claim 6, further including a net for separating waste from a mixture scraped up by said scraper and for storing the waste, said net being stretched on an upper surface of said travel body.

8. The cleaner according to claim 7, wherein the front portion of said travel body is provided with a slant portion having an upwardly extending front end.

9. The cleaner according to claim 7, wherein a rear portion of said travel body is provided with a slant portion having an upwardly extending rear end.

10. The cleaner according to claim 6, wherein the front portion of said travel body is provided with a slant portion having an upwardly extending front end.

11. The cleaner according to claim 6, wherein said traveling body includes an outer frame including said front portion, a left side member, a right side member and a rear member connected together for supporting said plurality of longitudinal members extending in the traveling direction of the cleaner.

12. A cleaner for recovering waste scattered on a ground surface, said cleaner comprising:

a travel body for carrying waste recovered during travel, said travel body having a plurality of longitudinal members and having in a front portion thereof a portion to be towed by a traction vehicle, said longitudinal members being arranged in a hurdle shape spacedly extending in a traveling direction of the cleaner;

a scraper for scraping up waste together with sand during travel, said scraper extending in a transverse direction across a mid-section of said travel body for delivering waste upwardly and away from sandy soil for removal of the waste;

a rotor being displaced a predetermined distance rearwardly of said scraper;

wherein the rotor serves as a sensor for detecting whether a certain volume of waste has accumulated in the travel body.

13. The cleaner according to claim 12, further including a net for separating waste from a mixture scraped up by said scraper and for storing the waste, said net being stretched on an upper surface of said travel body.

14. The cleaner according to claim 13, wherein the front portion of said travel body is provided with a slant portion having an upwardly extending front end.

15. The cleaner according to claim 13, wherein a rear portion of said travel body is provided with a slant portion having an upwardly extending rear end.

16. The cleaner according to claim 12, wherein the front portion of said travel body is provided with a slant portion having an upwardly extending front end.

17. The cleaner according to claim 12, wherein said traveling body includes an outer frame including said front portion, a left side member, a right side member and a rear member connected together for supporting said plurality of longitudinal members extending in the traveling direction of the cleaner.

18. The cleaner according to claim 12, further including a plurality of downwardly projecting members extending downwardly from said longitudinal members for engaging the ground surface for dislodging waste therefrom.

* * * * *